US006471551B2

(12) United States Patent
Morana et al.

(10) Patent No.: US 6,471,551 B2
(45) Date of Patent: Oct. 29, 2002

(54) CONNECTOR ASSEMBLY WITH SIDE-BY-SIDE TERMINAL ARRAYS

(75) Inventors: Frank P. Morana, Harrisburg, PA (US); Aurelio Jaime Gutierrez, Bonita, CA (US)

(73) Assignee: Pulse Engineering, Inc., San Diego, CA (US)

( * ) Notice: Subject to any disclaimer, the term of this patent is extended or adjusted under 35 U.S.C. 154(b) by 20 days.

(21) Appl. No.: 09/757,112

(22) Filed: Jan. 8, 2001

(65) Prior Publication Data

US 2001/0034161 A1 Oct. 25, 2001

Related U.S. Application Data

(63) Continuation of application No. 09/518,735, filed on Mar. 3, 2000, now Pat. No. 6,193,560.

(51) Int. Cl.[7] ..... H01R 24/00
(52) U.S. Cl. ..... 439/676; 439/541.5
(58) Field of Search ..... 439/676, 541.5, 439/540.5, 903

(56) References Cited

U.S. PATENT DOCUMENTS

| | | | | |
|---|---|---|---|---|
| 5,085,590 A | | 2/1992 | Galloway | 439/95 |
| 5,362,257 A | | 11/1994 | Neal et al. | 439/676 |
| 5,531,612 A | | 7/1996 | Goodall et al. | 439/541.5 |
| 5,587,884 A | | 12/1996 | Raman | 361/728 |
| 5,639,267 A | | 6/1997 | Loudemilk | 439/701 |
| 5,697,817 A | | 12/1997 | Bouchan et al. | 439/676 |
| 5,971,805 A | | 10/1999 | Belopolsky et al. | 439/620 |
| 5,971,813 A | | 10/1999 | Kunz et al. | 439/676 |
| 6,022,245 A | | 2/2000 | Minich | 439/620 |
| 6,080,011 A | * | 6/2000 | Tsao et al. | 439/541.5 |
| 6,267,628 B1 | * | 7/2001 | Meckley et al. | 439/676 |
| 6,280,256 B1 | * | 8/2001 | Belopolsky et al. | 439/676 |
| 2001/0005653 A1 | * | 6/2001 | Belopolsky | 439/541.5 |

* cited by examiner

*Primary Examiner*—Brian Sircus
*Assistant Examiner*—Hae Moon Hyeon
(74) *Attorney, Agent, or Firm*—Knobbe, Martens, Olson & Bear LLP

(57) ABSTRACT

A connector assembly (1) has a lower row of side-by-side terminal arrays (28) having a common dielectric carrier (30), and an upper row of side-by side terminal arrays (34) having a common dielectric carrier (3), each of the carriers (30) has guide sections (40) at opposite lateral ends, the carriers (30) are installed one behind the other, with the guide sections (40) being guided along common guides (19) of the housing (4), and the housing (4) has a resilient latch arm (20) that extends between the side-by-side terminal arrays (28 and 34), and holds the carriers (30) one behind the other.

10 Claims, 7 Drawing Sheets

CONNECTOR ASSEMBLY WITH SIDE-BY-SIDE TERMINAL ARRAYS

This application is a continuation of Ser. No. 09/518,735, filed Mar. 3, 2000, now U.S. Pat. No. 6,193,560.

FIELD OF THE INVENTION

The present invention relates to a connector assembly with terminal arrays for installation with plug receiving cavities, and, more particularly, to a connector assembly with side-by-side terminal arrays having a common dielectric carrier.

BACKGROUND OF THE INVENTION

A known connector assembly has multiple receptacle connectors in a common housing, which provides a compact arrangement of such receptacle connectors. Such a connector assembly is useful to provide multiple telephone connection ports. Accordingly, such a connector assembly is referred to as a multiple port connector assembly. Specifically, the receptacle connectors are in the form of RJ-11 type modular jacks that provide such ports for connection with a telephone switching network of a telephone service provider, such as, a regional telephone company or national telephone company.

The receptacle connectors, that is, modular jacks, each have electrical terminals arranged in a terminal array, and a plug receiving cavity. The modular jacks establish mating connections with RJ-11 modular plugs that terminate opposite ends of telephone cords leading to wall mounted telephone outlets inside a building. The telephone outlets connect to telephone lines outside of the building, which, in turn, connect to the telephone switching network of the telephone service provider.

As disclosed in U.S. Pat. No. 5,531,612, a known connector assembly has two rows of receptacle connectors, that is, modular jacks, arranged side-by-side in an upper row and side-by-side in a lower row in a common housing, which advantageously doubles the number of receptacle connectors without having to increase the length of the housing. The receptacle connectors have plug receiving sections with plug receiving cavities that are profiled to surround modular plugs that are to be inserted in the cavities. The modular plugs have resilient latches, which engage with latching sections on the modular jacks. The latches are capable of being grasped by hand, and being resiliently bent inwardly toward the plugs to release them from engagement with the latching sections on the modular jacks.

As discussed in the patent, the receptacle connectors in the upper row are arranged back to back with the receptacle connectors in the lower row. Further, plug receiving sections of the receptacle connectors in the upper and lower rows are arranged in substantially mirror image dispositions relative to a line between the upper and lower rows. The advantage, is that the back to back rows provide good access to the resilient latches of the modular plugs, for grasping and releasing the latches from engagement with the latching sections on the modular jacks.

Further, as discussed in the patent, the receptacle connectors include modular jack inserts. Each modular jack insert is constructed with multiple electrical terminals arranged in a terminal array. Each terminal array has an overmolded dielectric insert. The terminal arrays are installed, one by one, in respective ones of the receptacle connectors. One of the disadvantages of the known connector assembly, is the slow process of installing the terminal arrays one-by-one.

What is needed is a connector assembly that eliminates the slow process of assembling terminal arrays one-by-one.

As described by the patent, there are resilient latches integrally attached to the housing, which project into each one of the plug receiving cavities to latch to the dielectric inserts. Specifically, the dielectric inserts are installed, one by one, into the plug receiving cavities, making sure that the resilient latches become biased into latching positions to hold the dielectric inserts in place. Having the latches at each of the plug receiving cavities means that the latches are necessarily small in size, and are relatively weak and easily damaged. What is needed is a housing with a latching system having an integral latch that is of robust size and strength to hold dielectric inserts in place, and yet provide such a latching system in a minimal amount of space.

Providing the latches at each of the plug receiving cavities results in a molded part of complex structure. Such a complex structure increases the attendant cost of constructing molding dies that mold fluent dielectric material to form the latches. Further, both the speed of the production process, and the yield of production, are significantly reduced by the complex structure. What is needed is a connector assembly that eliminates multiple latches at each of the plug receiving cavities.

SUMMARY OF THE INVENTION

The invention provides a connector assembly including, a lower row of side-by side-terminal arrays having a first common dielectric carrier, and an upper row of side-by-side terminal arrays having a second common dielectric carrier. By providing the terminal arrays with common dielectric carriers, the invention eliminates the problems associated with having to install such terminal arrays one by one in a housing.

According to a feature of the invention, opposite lateral ends of each of the common carriers have guide sections. A single pair of guides are in the housing along which said pairs of guide sections are guided. Specifically, both common carriers are installed, one carrier behind the other carrier, with each pair of guide sections being guided one behind the other along a common pair of guides in the housing. Accordingly, the connector assembly further provides a housing of simplified construction, by having a single pair of guides to guide the guide sections both common carriers.

According to a further feature of the invention, both of the common dielectric carriers are held in place by a single latching arm on the housing. By requiring only a single latching arm, the connector assembly provides the advantage of a simplified housing structure capable of high speed production, and attaining high production yield. The single latching arm on the housing that holds both of the common dielectric carriers in place is robust in size and strength, and yet provides a latching system in a minimal amount of space. Further, the latch is externally of the plug receiving cavities, and eliminates numerous latches to hold individual terminal arrays.

DESCRIPTION OF THE DRAWINGS

An embodiment of the invention will now be described by way of example, with reference to the accompanying drawings, according to which.

DETAILED DESCRIPTION

Figure 1:
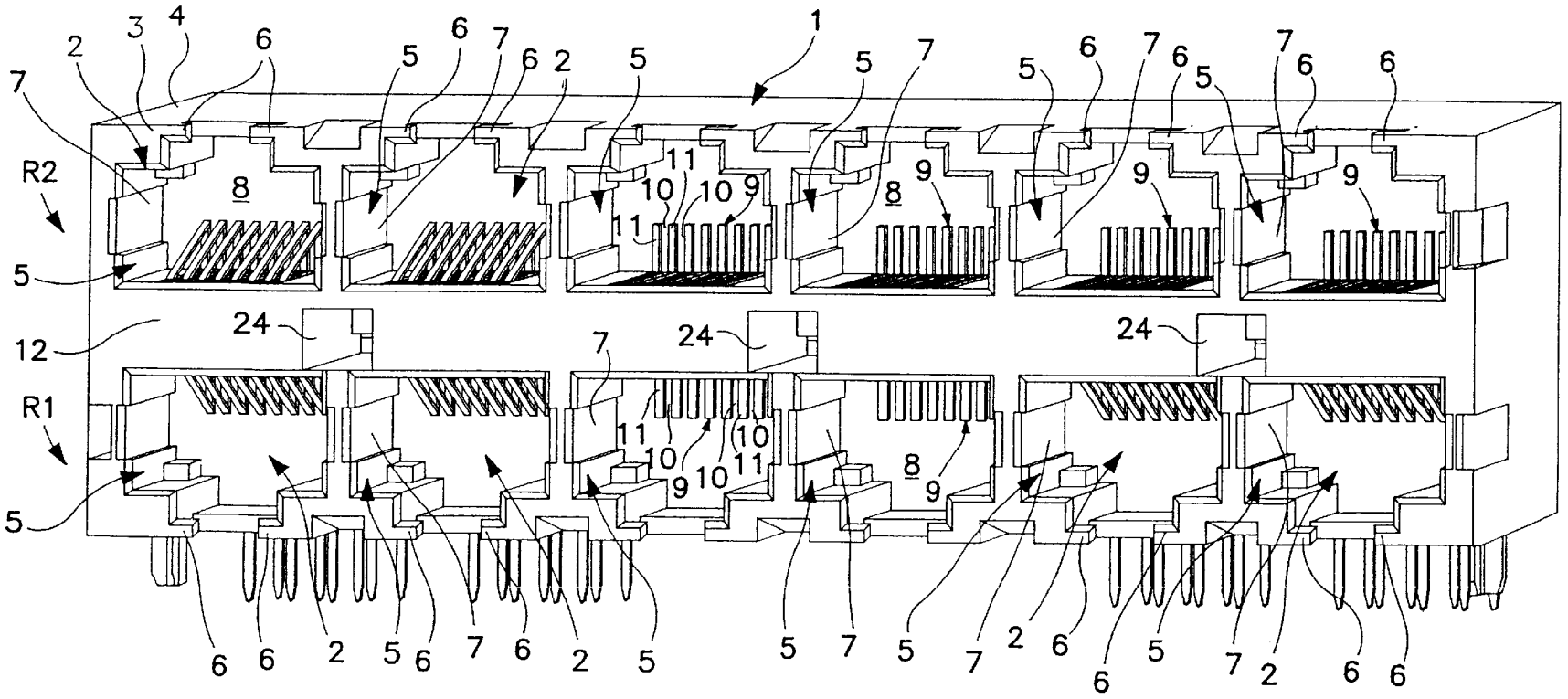
FIG. 1 is an isometric view of a housing of a connector assembly, and further showing examples of terminal arrays installed in side-by-side sections of the housing to provide side-by-side receptacle connectors.

With reference to FIG. 1, a connector assembly 1 has multiple receptacle connectors 2 in a front mating face 3 of a common housing 4. Such a connector assembly 1 is useful to provide multiple telephone connection ports. Accordingly, such a connector assembly 1 is referred to as a multiple port connector assembly 1. Specifically, the receptacle connectors 2 are in the form of RJ-11 type modular jacks that provide such ports. The modular jacks establish mating connections with known electrical plugs in the form of RJ-11 modular plugs. The receptacle connectors 2, that is, modular jacks, each have plug receiving cavities 5 that are profiled to surround modular plugs that are to be inserted in the cavities 5. The modular plugs have resilient latches, which engage with latching protrusions 6 along the front mating face 3 of the housing 4. The latches of the modular plugs are capable of being grasped by hand, and being resiliently bent inwardly toward the plugs to release them from engagement with the latching protrusions 6.

The connector assembly 1 has two rows of receptacle connectors 2, that is, modular jacks, arranged side-by-side in a lower row R1, and side-by-side in an upper row R2 in the housing 4, which advantageously doubles the number of receptacle connectors 2 without having to increase the length of the housing 4. The side-by-side receptacle connectors 2 in the lower row R1 are arranged back to back with those in the upper row R2. The receptacle connectors 2 in the rows R1 and R2 are arranged in substantially mirror image dispositions relative to a line between the rows R1 and R2. The advantage, is that the back to back receptacle connectors 2 provide good access to the resilient latches of the modular plugs, for grasping and releasing the latches from engagement with the latching protrusions 6.

FIG. 1 shows that the side-by-side plug receiving cavities 5 in the lower row R1, are separated from each other by vertical side walls 7. Similar vertical side walls 7 separate side-by-side plug receiving cavities 5 in the upper row R2. Such side walls 7 extend from the front mating face 3 of the housing 4, and extend rearwardly into the interior of the housing 4, until they meet with an interior vertical transverse wall 8 of the housing 4. The vertical transverse wall 8 extends transversely across each of the plug receiving cavities 5. Further, combs 9 having spaced apart teeth 10 are integrally formed in the vertical transverse wall 8. The combs 9 have arrays of narrow, terminal receiving openings 11 through the vertical transverse wall 8. The teeth 10 of the combs 9 are between the terminal receiving openings 11 of the combs 9. There are side-by-side combs 9 in the upper row R2 and side-by-side arrays of terminal receiving openings 11 in the upper row R2, which are in alignment with side-by-side plug receiving cavities 5 in the upper row R2. Similarly, there are side-by-side combs 9 in the lower row R1 and side-by-side arrays of terminal receiving openings 11 in the lower row R1, which are in alignment with side-by-side plug receiving cavities 5 in the lower row R1.

Figure 2:
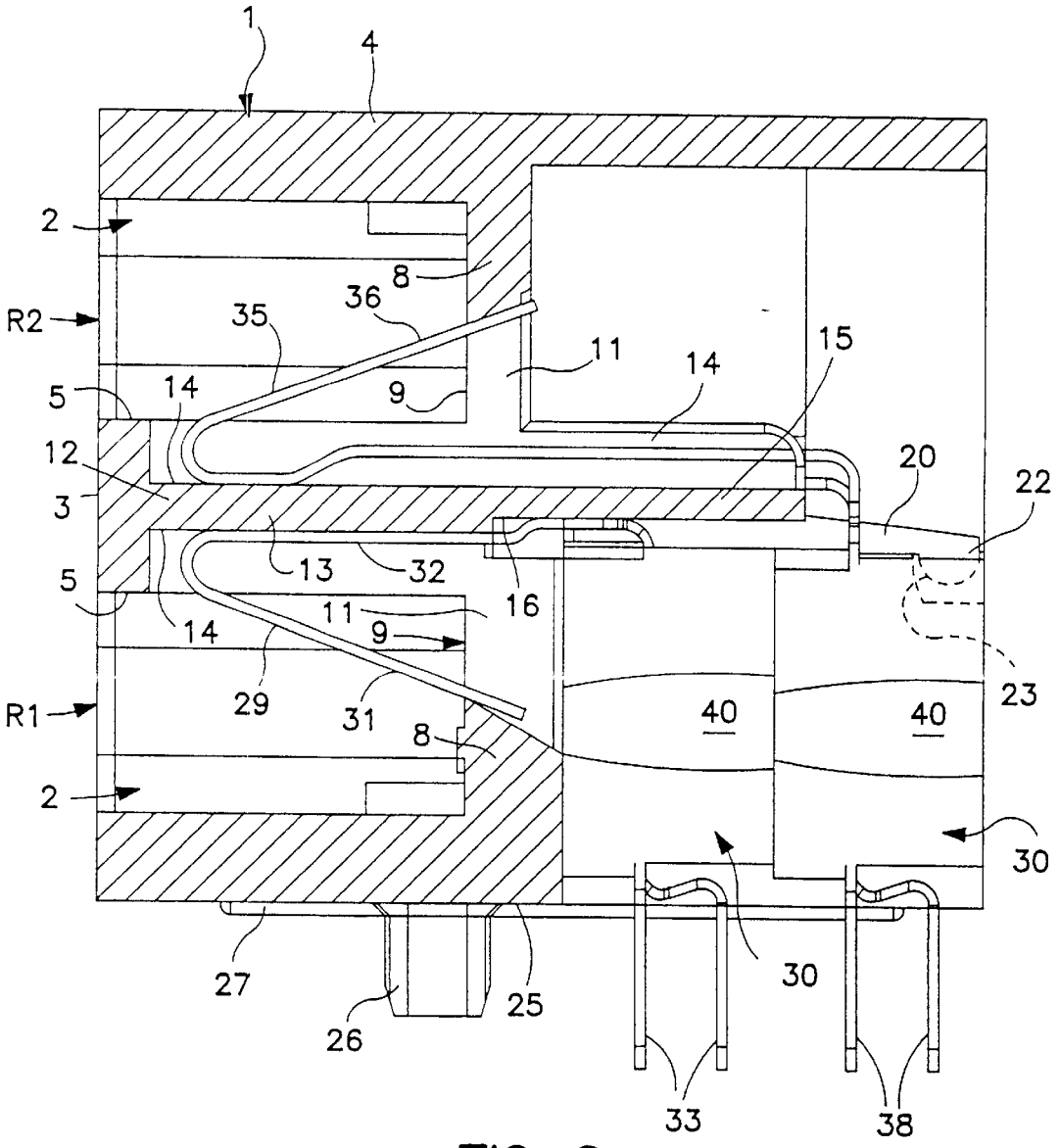
FIG. 2 is an enlarged cross section of the housing shown in FIG. 1, and further showing terminals installed in both an upper row and a lower row, the terminals having dielectric carriers installed one behind the other.

Further, FIG. 1 shows that the upper row R2 of receptacle connectors 2 are separated from those in the lower row R1 by a horizontal interior wall 12 of the housing 4. Such horizontal interior wall 12 is shown further in cross section in FIG. 2. With reference to FIG. 2, the horizontal interior wall 12 has a forward portion 13 extending forwardly of the vertical transverse wall 8 to the front mating face 3. Terminal receiving grooves 14 are in a top side of the horizontal interior wall 12. Further, these terminal receiving grooves 14 are arranged in side-by-side arrays that extend within respective side-by-side plug receiving cavities 5 of the upper row R1. Similarly, additional terminal receiving grooves 14 are in an underside of the horizontal interior wall 12, which are arranged in side-by-side arrays that extend within respective side-by-side plug receiving cavities 5 of the lower row R1. Respective terminal receiving grooves 14 form connecting passages with respective terminal receiving openings 11 of the combs 9.

As further shown in FIG. 2, the terminal receiving grooves 14 in the top side of the horizontal interior wall 12 extend through the vertical transverse wall 8, to provide connecting passages to the rear of the vertical transverse wall 8. Further, the terminal receiving grooves 14 extend in a rearward portion 15 of the horizontal interior wall 12 that extends rearwardly of the vertical transverse wall 8. Similarly, the additional terminal receiving grooves 14 in the underside of the horizontal interior wall 12 extend through the vertical transverse wall 8 to provide connecting passages to the rear of the vertical transverse wall 8. Further, the rearward portion 15 of the horizontal interior wall 12 is made thinner by a stepped underside 16, FIG. 2, to provide access to the additional terminal receiving grooves 14. In the underside of the horizontal interior wall 12.

Figure 3:
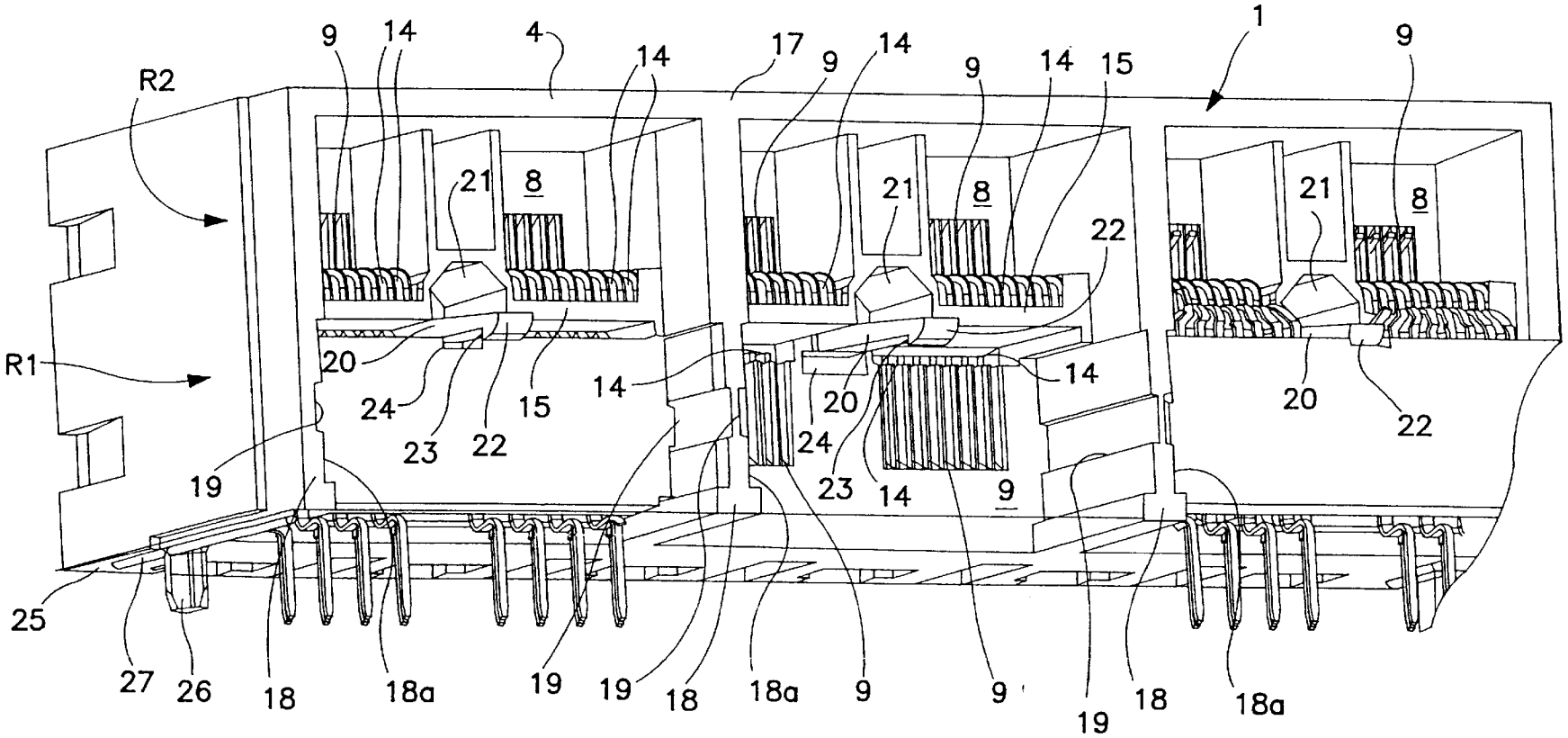
FIG. 3 is an isometric view of a rear of the housing as shown in FIG. 1, and further showing examples of dielectric carriers for terminal arrays, which examples are installed in side-by-side sections of the housing.

The rear of the vertical transverse wall 8 is best seen in FIG. 3, showing a rear face 17 of the housing 4 that is substantially open to view the combs 9 and the terminal receiving grooves 14. Specifically, there are side-by-side arrays of terminal receiving grooves 14 in the upper row R2, which are aligned with the side-by-side combs 9 in the upper row R2. Further, there are side-by-side arrays of additional terminal receiving grooves 14 in the lower row R1, which are aligned with the side-by-side combs 9 in the lower row R1.

With continued reference to FIG. 3, the rear of the housing 4 has spaced apart vertical partitions 18 that divide the rear of the housing 4 into one or more side-by-side sections 18*a*. Each side-by-side-section 18*a* of the housing 4 includes at least two side-by-side combs 9 of the upper row R2, and at least two side-by-side combs 9 of the lower row R1. Although FIG. 3 shows the side-by-side combs 9, in each row R1 and R2, as being at least two in number for each section 18*a* of the housing 4, such number can be increased beyond two, to as large a number as is reasonable.

With continued reference to FIG. 3, each side-by-side section 18*a* of the housing 4 is a carrier receiving area that is between the vertical partitions 18. The vertical partitions 18 have common guides 19 in the form of a single pair of alignment grooves facing the carrier receiving area. The common guides 19 in the form of such alignment grooves extend from the rear face 17 forwardly toward the vertical transverse wall 8.

With further reference to FIG. 3, each side-by-side section 18*a* of the housing 4 has a single resilient latching arm 20. The latching arm 20 extends rearwardly, and is free to deflect resiliently within a clearance provided by an arch shaped recess 21 in a thickened section of the rearward portion 15 of the horizontal interior wall 12. The latching arm 20 has a tapered tip 22 with an undercut latching shoulder 23 that is aligned rearwardly of a core pin passage 24 through the vertical transverse wall 8. Further the core pin passage 24 extends entirely through the housing 4, and emerges as an enlarged, core pin passage 24 at the front mating face 3, as shown in FIG. 1.

With continued reference to FIG. 3, the latching arm 20 is an integral part of the housing 4, which is formed by molding dielectric material in a mold cavity of a molding apparatus. The undercut latching shoulder 23 of the latching arm 20 is formed by a first core pin of the molding apparatus that projects into the mold cavity, and that further forms the core pin passage 24. The arch shaped opening 21 is formed by a second core pin of the molding apparatus that projects into the mold cavity. Similarly, additional core pins project into the mold cavity to form the respective shapes of the plug receiving cavities 5, the combs 9 in the vertical transverse wall 8, the grooves 14 in the horizontal interior wall 12, and the partitions 18 that have the common guides 19 in the form of alignment grooves.

As further shown in FIG. 3, the housing 4 is adapted for mounting on a printed circuit board, PCB. A bottom 25 of the housing has projecting alignment posts 26 that are adapted to register in alignment openings through the thickness of the PCB. Thin ribs 27 on the bottom 25 of the housing 4 provide projecting standoffs adapted to engage a surface of the PCB, and to lift the bottom 25 of the housing 4 slightly above the PCB.

Figure 4:
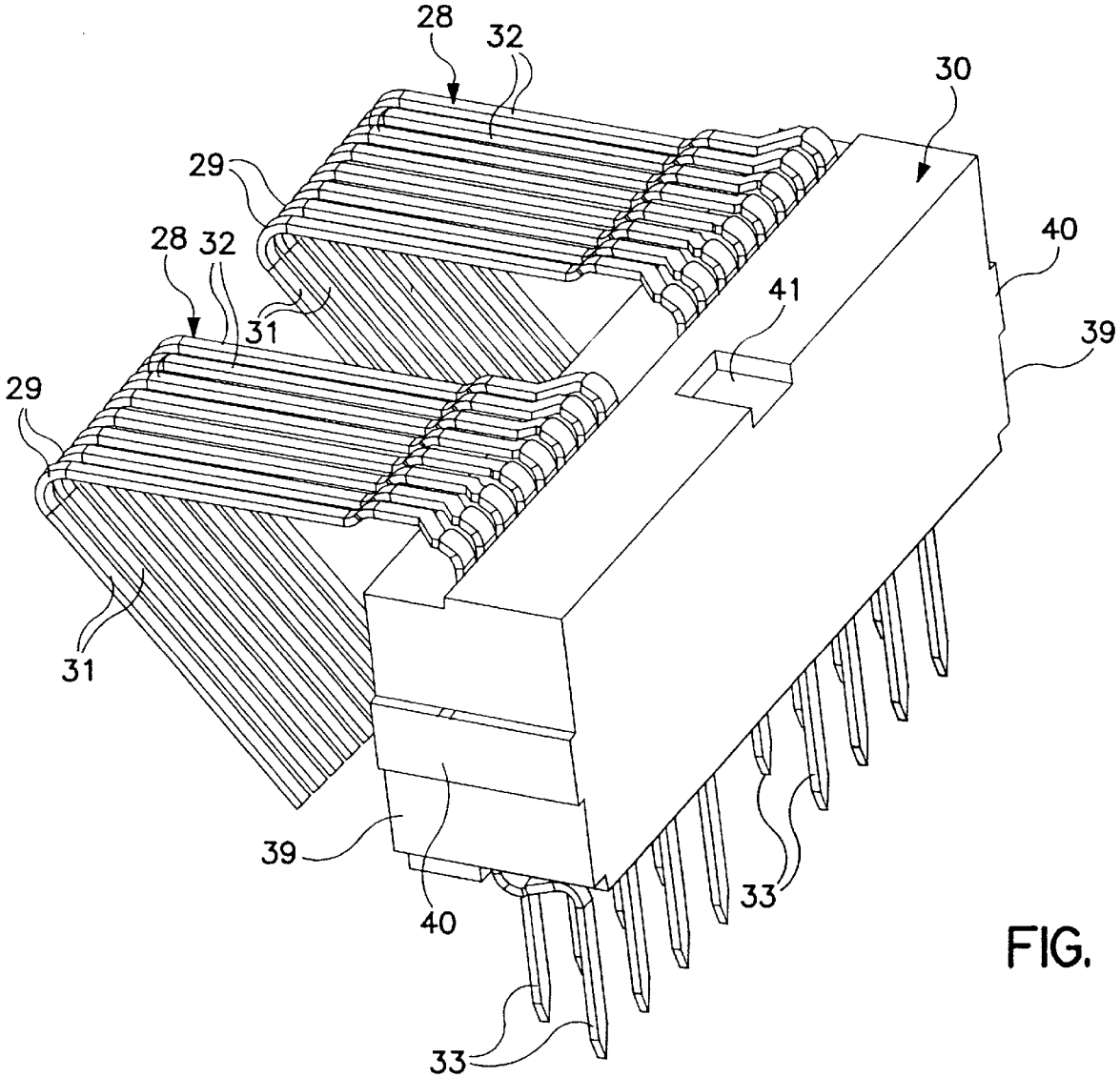
FIG. 4 is an isometric view of a lower row of side-by-side terminal arrays having a common dielectric carrier.

Attention is directed to FIG. 4, showing at least two side-by-side terminal arrays 28. Each terminal array 28 has electrical terminals 29 that are thin and elongated, and are laterally spread apart. FIG. 4 shows the terminal arrays 28 arranged side-by-side, and having a common dielectric carrier 30. For example, the terminal arrays 28 are formed by stamping a flat sheet of metal, followed by overmolding dielectric material onto the terminal arrays 28 to form the common dielectric carrier 30. Subsequently, the side-by-side terminal arrays 28 are trimmed of unneeded metal, and are bent to the shapes as shown in FIG. 4. The terminals 29 are bent to acute angles to provide doubled back, plug contacting portions 31, midportions 32, and PCB contacting portions 33 that project below the common dielectric carrier 30 to plug into a PCB. Alternate ones of the PCB contacting portions 33 are straight to extend in a first row. And further alternate ones of the PCB contacting portions 33 are bent to extend in a second row. As shown in FIG. 3, each section 18*a* of the housing 4 receives the side-by-side terminal arrays 28 that are provided for the lower row R1. Specifically, the side-by-side terminal arrays 28 are provided for installation with respective side-by-side combs 9 and respective side-by-side plug receiving cavities 5 in the lower row R1.

Figure 5:
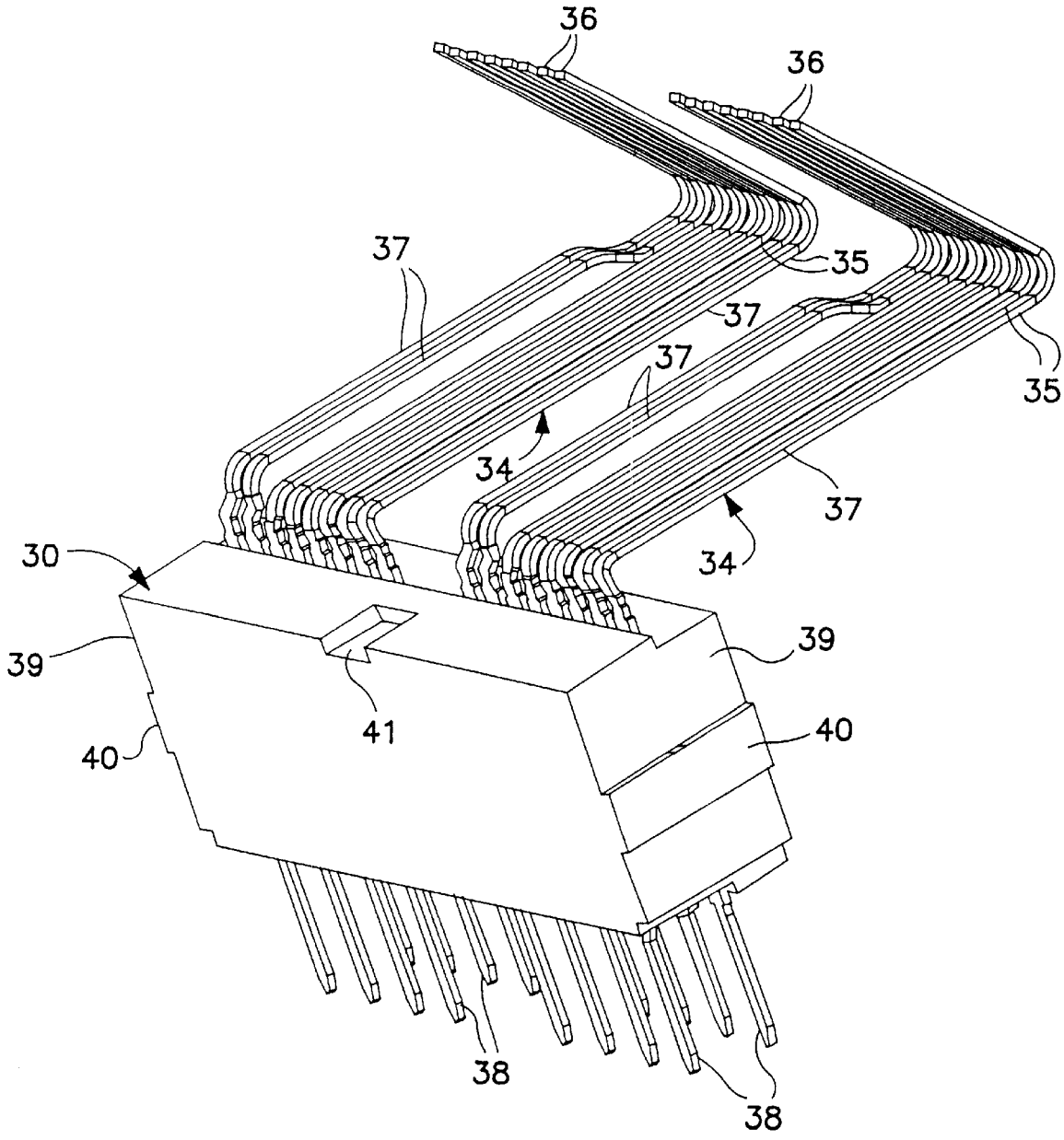
FIG. 5 is an isometric view of an upper row of side-by-side terminal arrays having a common dielectric carrier.

Attention is directed to FIG. 5, showing at least two side-by-side terminal arrays 34. Each terminal array 34 has electrical terminals 35 that are thin and elongated, and are laterally spread apart. FIG. 4 shows the terminal arrays 34 arranged side-by-side, and having a common dielectric carrier 30 that is a duplicate of the previously discussed dielectric carrier 30. For example, the terminal arrays 34 are formed by stamping a flat sheet of metal, followed by overmolding dielectric material onto the terminal arrays to form the common dielectric carrier 30. Subsequently, the side-by-side terminal arrays 34 are trimmed of unneeded metal, and are bent to the shapes as shown in FIG. 5. The terminals 35 are bent at acute angles to provide doubled back, plug contacting portions 36, midportions 37, and PCB contacting portions 38 that project below the common dielectric carrier to plug into a PCB. Alternate ones of the PCB contacting portions 38 are straight to extend in a first row. And further alternate ones of the PCB contacting portions 38 are bent to extend in a second row. FIG. 5 shows that all but two of the midportions 37 are coplanar in a first plane, and that two of the midportions 37 have offset sections that are elevated to extend in a different plane that is offset from the first plane. The midportions 37 that are elevated, have a reduced tendency for inducing cross talk in the remaining midportions 37.

As shown in FIG. 3, each section 18*a* of the housing 4 receives the side-by-side terminal arrays 34 that are provided for the upper row R2. Specifically, the side-by-side terminal arrays 34 are provided for installation with respective side-by-side combs 9 and respective side-by-side plug receiving cavities 5 in the upper row R2.

The common dielectric carriers 30, as shown in FIGS. 4 and 5, are duplicates of each other, which simplifies their manufacture and, further, which simplifies their installation in the housing 4. With reference to FIGS. 4 and 5, each of the dielectric carriers 30 has a pair of opposite lateral ends 39 with unitary guide sections 40 that are elongated, forward and rearward. Specifically, the guide sections 40 have projecting rails that are slightly tapered in both directions, forward and rearward, to prevent jamming during installation in the housing 4. Each of the dielectric carriers 30 has a latching detent 41.

Installation of the terminal arrays 28 of the lower row R1 will now be described with reference to FIGS. 6 and 7. The side-by-side terminal arrays 28 of the lower row R1 are installed first, followed by installation of the side-by-side terminal arrays 34 of the upper row R2. Specifically, the side-by-side terminal arrays 28 of the lower row R1, together with the common dielectric carrier 30, are installed into a corresponding section 18*a* of the housing 4, with the single latching arm 20 extending between the side-by-side terminal arrays 28. Further, the common dielectric carrier 30 for the lower row registers against the rear of the vertical transverse wall 8.

Figure 6:
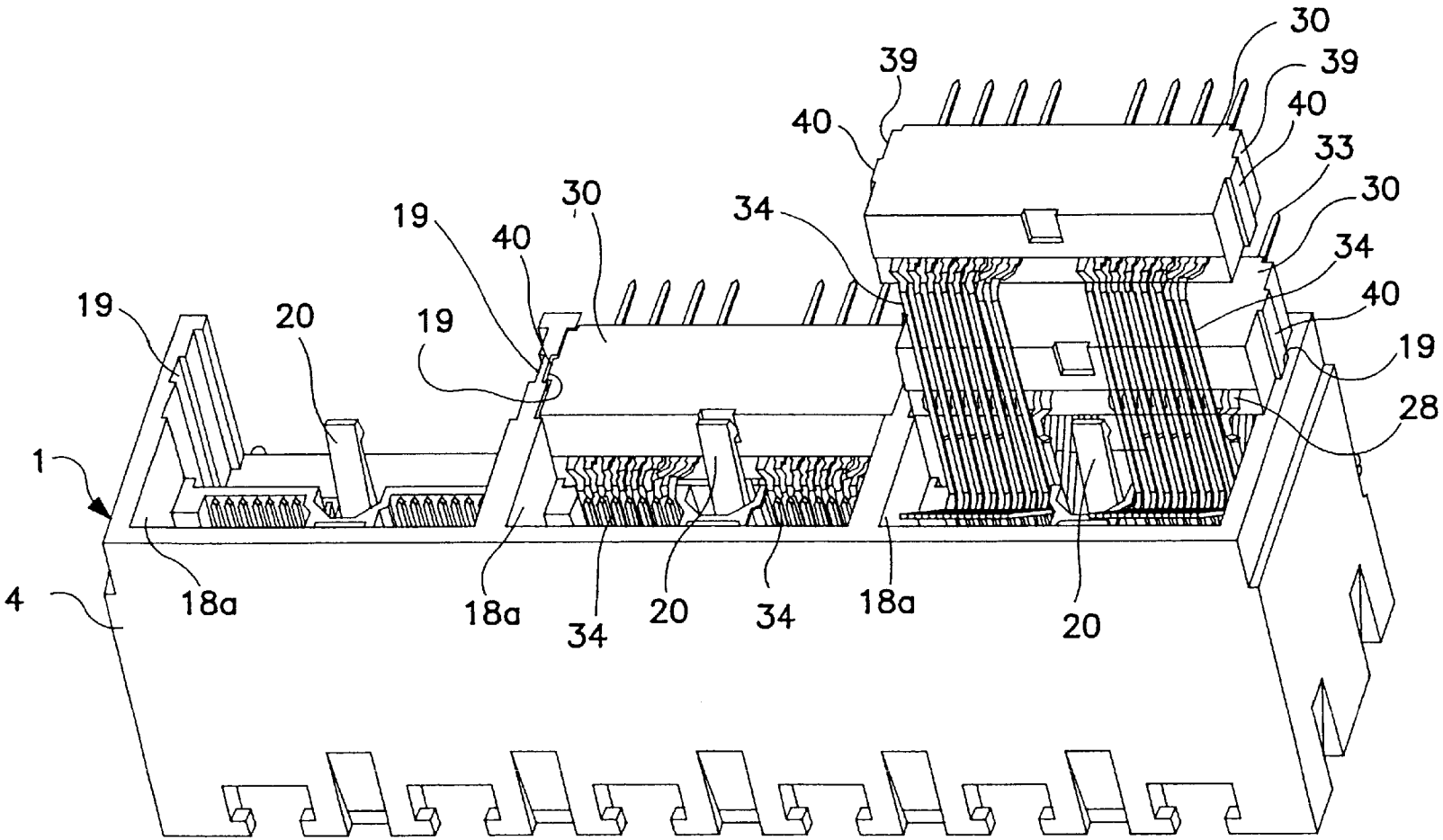
FIG. 6 is an isometric view of a rear of the housing as shown in FIG. 2, and further showing terminal arrays having dielectric carriers in the process of being installed in the housing.
Figure 7:
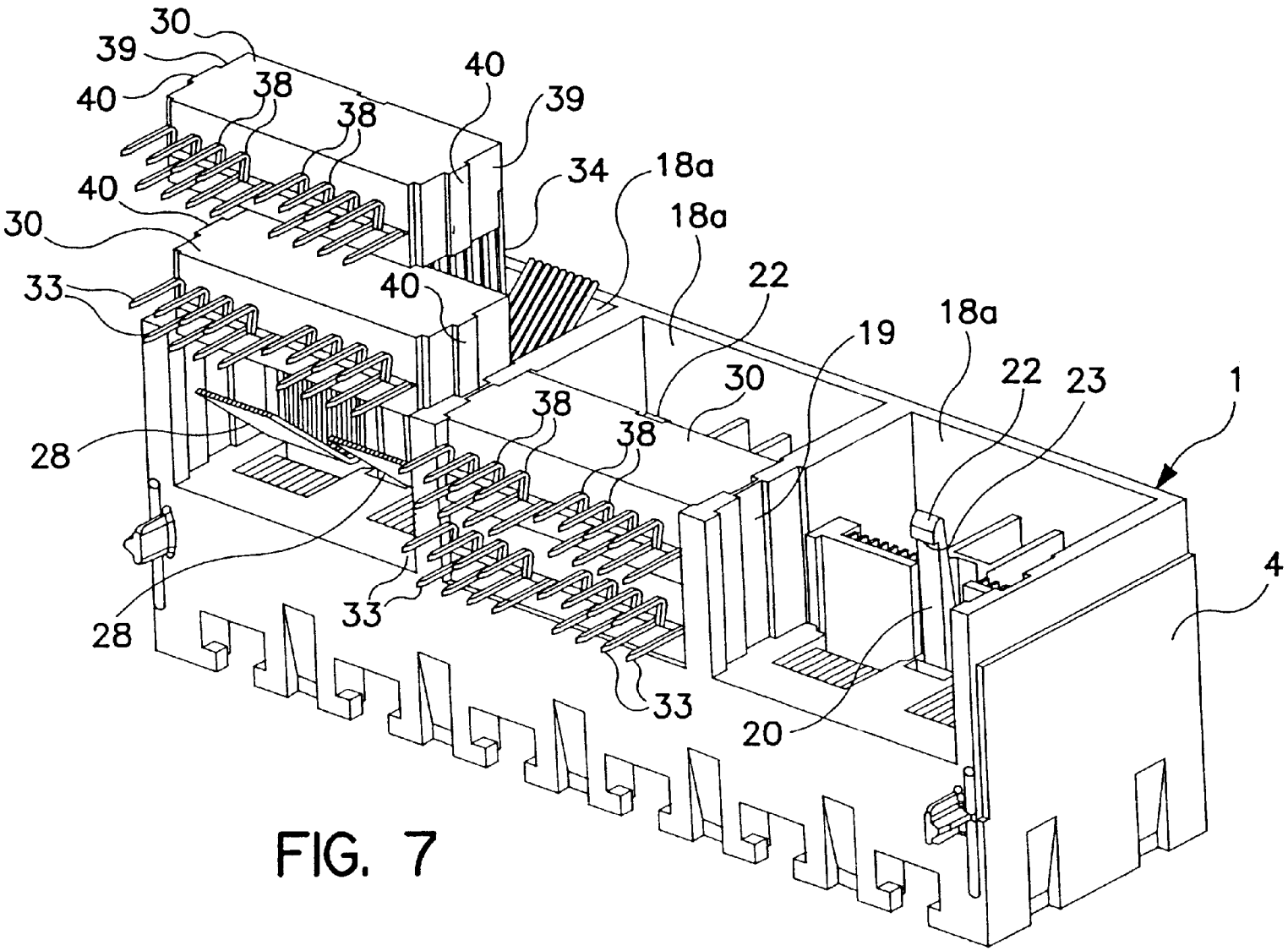
FIG. 7 is an isometric view similar to FIG. 6.

With further reference to FIGS. 6 and 7, the side-by-side terminal arrays 34 of the upper row, together with the common dielectric carrier, are installed into a corresponding section 18*a* of the housing 4, with the single latching arm 20 extending between the side-by-side terminal arrays 34. Further, the dielectric carriers 30 of both the lower and upper terminal arrays 28 and 34 are installed one said carrier 30 behind the other said carrier 30. By providing the side-by-side terminal arrays 28 and 34 with respective common dielectric carriers 30, the invention eliminates the problems associated with having to install such terminal arrays 28 and 34 one by one.

With continued reference to FIGS. 6 and 7, as the dielectric carriers 30 of the terminal arrays 28 and 34 are installed, one said carrier 30 behind the other said carrier 30, the guide sections 40, in the form of rails, are guided along the common guides 19, in the form of a single pair of grooves, of the housing 4. Accordingly, the connector assembly 1 provides a housing of simplified construction, by having a single pair of guides 19 in the form of a single pair of grooves to guide the guide sections 40 on both dielectric carriers 30.

The dielectric carriers 30 as they are installed, bias the tapered tip 22 of the single latching arm 20 outward. Once the dielectric carriers 30 are past the tapered tip 22, the latching arm 20 resiliently biases the tapered tip 22 to register the latching shoulder 23 in the latching detent 41 of the corresponding carrier 30 that is installed behind the other carrier 30, which holds said carriers 30 one behind the other. The latch arm 20 engages the corresponding carrier 30 midway between the lateral ends 39 to distribute forces evenly between the side-by-side terminal arrays 34. Further, the housing 4 is provided with a latching system having an integral latch 20 that is of robust size and strength to hold the dielectric carriers 30 in place, and yet such a latching system is provided in a minimal amount of space.

As shown in the cross section of FIG. 2, the terminals 28 and 35 are installed through respective combs 9, and extend along the grooves 14 in the horizontal interior wall 12. The doubled back, plug contacting portions 31 and 36 are installed within respective plug receiving cavities 5 for mating connection with electrical plugs that plug into the plug receiving cavities 5. The plug contacting portions 31 and 36 resiliently bias against inclined sections of respective combs 9 to deflect to a smaller acute angle, which preloads them with resilient spring energy. The PCB contacting portions 33 and 38 project beyond the bottom 25 of the housing 4 for connection to a PCB. As further shown in FIG. 2, the latching arm 20 holds the terminal arrays 34 of the upper row R2 behind the terminal arrays 28 of the lower row R1 to position the PCB contacting portions 33 and 38 one behind the other. As further shown in FIG. 2, the latching arm 20 holds the dielectric carriers 30 in abutment with each other, against the rear of the vertical transverse wall 8.

Other embodiments and modifications of the invention are intended to be covered by the spirit and scope of the appended claims.

What is claimed is:

1. A microelectronic connector body, comprising:

a front face having at least two cavities in a vertical dimension, said cavities being adapted to receive modular plugs;

a rear face having at least one pair of vertical partitions defining an aperture for receiving a plurality of electrical components, wherein each of the vertical paritions of said pair of vertical partitions has a single alignment groove facing the aperture; and a dividing wall separating said front from said back, said dividing wall having openings for allowing leads to pass between said back and said front, wherein said aperture is configured to receive a first electrical component having first guide sections at substantially opposite lateral ends thereof such that said first guide sections are received into said alignment grooves in said vertical partitions, and wherein said aperture is further configured to receive a second electrical component having second guide sections at substantially opposite lateral ends thereof positioned behind said first electrical component such that said second guide sections are received into said alignment grooves in said vertical partitions behind the first guide sections.

2. The microelectronic connector body according to claim 1, wherein said housing is provided with a latch arm for engaging at least one of said at least two electrical components so as to secure said at least two electrical components within said aperture.

3. A method of manufacturing a microelectronic connector, comprising:

providing a housing with a front face having at least two cavities in a vertical dimension, said cavities being adapted to receive modular plugs, a rear face having at least one pair of vertical partitions defining an aperture for receiving a plurality of electrical components, and a dividing wall separating said front from said back, said dividing wall having openings for allowing leads to pass between said back and said front, wherein each of the vertical partitions of said pair of vertical partitions has a single alignment groove facing the aperture;

inserting a first electrical component having first guide sections at substantially opposite lateral ends thereof into said aperture such that a first face of said electrical component is positioned adjecent said dividing wall and such that a first set of leads passes through said openings into one of said cavities in said front face of said housings, and said first guide sections are reeived into the alignment grooves of the vertical partitions; and inserting a second electrical component having second guide sections at substantially opposite lateral ends thereof into said aperture such that said second electrical component is positioned behind said first electrical component and said second guide sections are received into the alignment grooves of the vertical partitions, and wherein said act of inserting includes passing a set of leads through said openings into one of said cavities in said front face of housing.

4. The method according to claim 3, wherein said housing is provided with a latch arm for engaging the second electrical component.

5. The method according to claim 4, further comprising engaging said second electrical component with said latch arm so as to secure said at least two electrical components within said aperture.

6. A microelectronic connector assembly, comprising:

a housing comprising a front face, a rear face, a vertical transverse wall, and at least one pair of vertical partitions, wherein the front face defines at least a first cavity and a second cavity adapted to receive modular plugs therein, and said at least one pair of vertical partitions defining a carrier receiving area in the rear face, wherein each of the vertical partitions of said pair of vertical partitions has a single alignment groove facing the carrier receiving area;

a first dielectric carrier received within the carrier receiving area, the first dielectric carrier having a row of terminal arrays which are configured to extend through the vertical transverse wall and into the first cavity, and wherein said first dielectric carrier has guide sections at substantially opposite lateral ends thereof; and a second dielectric carrier received within the carrier receiving area and positioned behind the first dielectric carrier, said second dielectric carrier having a row of terminal arrays, wherein the row of terminal arrays are configured to extend through the vertical transverse wall and into the second cavity, and wherein said second dielectric carrier comprises guide sections at opposite lateral ends thereof that are received within the same alignment grooves in the pair of vertical partitions as the guide sections of the frist dielectric carrier.

7. The microelectronic assembly of claim 6, wherein the first cavity is a lower cavity and the second cavity is an upper cavity positioned above the lower cavity.

8. The microelectronic assembly of claim 6, wherein the alignment grooves extend from the rear face forwardly toward the vrtical transverse wall.

9. The microelectronic assembly of claim 6, wherein the guide sections are rails and are received in the alignment of groove in each of the pair of vertical partitions.

10. The microelectronic assembly of claim 6, wherein the housing further comprises a resilient latch arm for engaging the second dielectric carrier and holding said second carrier behind the first carrier.

* * * * *

UNITED STATES PATENT AND TRADEMARK OFFICE

CERTIFICATE OF CORRECTION

PATENT NO. : 6,471,551 B2
DATED : October 9, 2002
INVENTOR(S) : Morana et al.

It is certified that error appears in the above-identified patent and that said Letters Patent is hereby corrected as shown below:

Column 7,
Line 49, delete “paritions” and insert therefor, -- partitions --.

Column 8,
Line 13, delete “said front from said back” and insert therefor, -- said front face from said rear face --.
Line 15, delete “said back and said front” and insert therefor, -- said rear face and said front face --.
Line 24, delete “reeived” and insert therefor, -- received --.
Line 37, delete “of housing” and insert therefor, -- of said housing --.

Column 9,
Line 3, delete “frist” and insert therefor, -- first --.
Line 10, delete “vrtical” and insert therefor -- vertical --.

Signed and Sealed this

Sixth Day of January, 2004

JAMES E. ROGAN
*Director of the United States Patent and Trademark Office*